US010242820B1

(12) United States Patent
Chiang et al.

(10) Patent No.: US 10,242,820 B1
(45) Date of Patent: Mar. 26, 2019

(54) LUMINOUS KEYBOARD

(71) Applicant: Primax Electronics Ltd., Taipei (TW)

(72) Inventors: Ying-Te Chiang, Taipei (TW); Bo-An Chen, Taipei (TW); Chin-Sung Pan, Taipei (TW); Chen-Hsuan Hsu, Taipei (TW)

(73) Assignee: PRIMAX ELECTRONICS LTD., Taipei (TW)

( * ) Notice: Subject to any disclaimer, the term of this patent is extended or adjusted under 35 U.S.C. 154(b) by 0 days.

(21) Appl. No.: 15/865,765

(22) Filed: Jan. 9, 2018

(30) Foreign Application Priority Data

Sep. 8, 2017 (TW) ..... 106130841 A

(51) Int. Cl.
*H01H 3/12* (2006.01)
*H01H 13/83* (2006.01)
*H01H 13/705* (2006.01)

(52) U.S. Cl.
CPC ..... *H01H 13/83* (2013.01); *H01H 3/125* (2013.01); *H01H 13/705* (2013.01)

(58) Field of Classification Search
CPC ..... H01H 13/83; H01H 13/705; H01H 3/125; H01H 2219/044; H01H 2219/062; H01H 13/703; H01H 13/702; G06F 3/0202
See application file for complete search history.

(56) References Cited

U.S. PATENT DOCUMENTS 8,770,772 B1 * 7/2014 Zhang ..... H01H 13/83 200/5 A
8,888,305 B2 * 11/2014 Chen ..... G02B 6/0083 200/310
9,040,856 B2 * 5/2015 Chen ..... H01H 13/83 200/310
9,322,985 B1 * 4/2016 Liang ..... G02B 6/0088
2015/0136573 A1 * 5/2015 Peterson ..... H01H 13/83 200/314

* cited by examiner

*Primary Examiner* — Peggy A Neils
(74) *Attorney, Agent, or Firm* — Muncy, Geissler, Olds & Lowe, P.C.

(57) ABSTRACT

A luminous keyboard includes plural keys, a membrane switch circuit member, a supporting plate and a backlight module. The membrane switch circuit member is located under the plural keys, and includes an upper wiring plate, a lower wiring plate and a separation plate. The supporting plate is located under the membrane switch circuit member and connected with the plural keys. The backlight module is located under the supporting plate to generate a light beam. A periphery region of at least one of the upper wiring plate, the lower wiring plate and the separation plate is bent to cover the supporting plate and the backlight module. Consequently, the light beam is not leaked out through the periphery region of the backlight module.

7 Claims, 6 Drawing Sheets

LUMINOUS KEYBOARD

FIELD OF THE INVENTION

The present invention relates to a keyboard, and more particularly to a luminous keyboard with an illuminating function.

BACKGROUND OF THE INVENTION

Generally, the widely-used peripheral input device of a computer system includes for example a mouse device, a keyboard, a trackball device, or the like. Via the keyboard, characters and symbols can be inputted into the computer system directly. As a consequence, most users and most manufacturers of input devices pay much attention to the development of keyboards.

FIG. 1 is a schematic top view illustrating the outer appearance of a conventional keyboard. As shown in FIG. 1, there are plural keys 10 on a surface of the conventional keyboard 1. These keys 10 are classified into several types, e.g. ordinary keys 101, numeric keys 102 and function keys 103. When one of these keys 10 is depressed by the user's finger, a corresponding signal is issued to the computer, and thus the computer executes a function corresponding to the depressed key. For example, when an ordinary key 101 is depressed, a corresponding English letter or symbol is inputted into the computer. When a numeric key 102 is depressed, a corresponding number is inputted into the computer. In addition, the function keys 103 (F1~F12) can be programmed to provide various functions. For example, the conventional keyboard 1 is a keyboard for a notebook computer.

With the maturity of the computing technologies, the keyboard manufacturers make efforts in designing novel keyboards with special functions in order to meet diversified requirements of different users. For this reason, luminous keyboards are favored by users. The outer appearance of the conventional luminous keyboard is substantially similar to the outer appearance of the conventional keyboard 1. Since the luminous keyboard provides the function of illuminating the keys, the inner structure of the luminous keyboard is different from the inner structure of the keyboard without the illuminating function. Hereinafter, the inner structure of the luminous keyboard will be illustrated in more details. FIG. 2 is a schematic cross-sectional view illustrating a conventional luminous keyboard. As shown in FIG. 2, the conventional luminous keyboard 2 comprises plural keys 20, a membrane switch circuit member 21, a supporting plate 22 and a backlight module 23. Each key 20 comprises a keycap 201, a scissors-type connecting element 202 and an elastic element 203. In the key 20, the keycap 201 is exposed outside the conventional luminous keyboard 2, so that the keycap 201 can be depressed by the user. The scissors-type connecting element 202 is used for connecting the keycap 201 and the supporting plate 22. The elastic element 203 is penetrated through the scissors-type connecting element 202. In addition, both ends of the elastic element 203 are contacted with the keycap 201 and the membrane switch circuit member 21, respectively. The supporting plate 22 is located under the membrane switch circuit member 21. The keycap 201, the scissors-type connecting element 202, the elastic element 203 and the membrane switch circuit member 21 are supported on the supporting plate 22.

The membrane switch circuit member 21 comprises an upper wiring board 211, a separation layer 212, and a lower wiring board 213. The upper wiring board 211, the separation layer 212 and the lower wiring board 213 are all made of a light-transmissible material. The light-transmissible material is for example polycarbonate (PC) or polyethylene (PE). The upper wiring board 211 has plural upper contacts 2111. The separation layer 212 is located under the upper wiring board 211, and comprises plural perforations 2121 corresponding to the plural upper contacts 2111. The lower wiring board 213 is located under the separation layer 212, and comprises plural lower contacts 2131 corresponding to the plural upper contacts 2111. The plural lower contacts 2131 and the plural upper contacts 2111 are collectively defined as plural key switches 214.

The backlight module 23 comprises a light guide plate 230, a circuit board 231, plural light-emitting elements 232, a reflecting plate 233 and a light-sheltering plate 234. For clarification and brevity, only two light-emitting elements 232 are shown in the drawing. The light guide plate 230 is located under the supporting plate 22. The circuit board 231 is located under the membrane switch circuit member 21 and electrically connected with the light-emitting elements 232. The circuit board 231 provides electric power to the plural light-emitting elements 232. The plural light-emitting elements 232 are disposed on the circuit board 231. In addition, the plural light-emitting elements 232 are inserted into plural reflecting plate openings 2331 of the reflecting plate 233 and plural light guide plate openings 2301 of the light guide plate 230, respectively. By acquiring the electric power, the plural light-emitting elements 232 are driven to emit plural light beams B. Moreover, the plural light beams B are introduced into the light guide plate 230. After portions of the light beams B are exited from the light guide plate 230, the light beams B are reflected back into the light guide plate 320 by the reflecting plate 233. The light-sheltering plate 234 is located over the light guide plate 230 for sheltering the light beams B. For example, the plural light-emitting elements 232 are side-view light emitting diodes. After the light beams B are introduced into the light guide plate 230, the light beams B are subjected to total internal reflection within the light guide plate 230. Then, the light beams B are guided to the keycap 201 by the light guide plate 230.

From top to bottom, the keycap 201, the scissors-type connecting element 202, the elastic element 203, the membrane switch circuit member 21, the supporting plate 22, the light-sheltering plate 234, the light guide plate 230 and the reflecting plate 233 of the conventional luminous keyboard 2 are sequentially shown. For example, the conventional luminous keyboard 2 is a keyboard for a notebook computer (not shown).

In the conventional luminous keyboard 2, each keycap 201 has a light-outputting zone 2011. The light-outputting zone 2011 is located at a character region or a symbol region of the keycap 201. Moreover, the position of the light-outputting zone 2011 is aligned with the position of a corresponding light-guiding dot 2302 of the light guide plate 230. The light beams can be guided upwardly to the light-outputting zone 2011 by the corresponding light-guiding dot 2302. The light-sheltering plate 234 comprises plural light-sheltering plate openings 2341. The plural light-sheltering plate openings 2341 are aligned with the corresponding light-guiding dots 2302 and the corresponding light-outputting zones 2011. Consequently, the light beams B are transmitted through the light-sheltering plate openings 2341 of the light-sheltering plate 234. Similarly, the supporting plate 22 comprises plural supporting plate openings 221. The plural supporting plate openings 221 are aligned with the corresponding light-guiding dots 2302 and the corresponding light-outputting zones 2011. Consequently, the light beams B are transmitted through the supporting plate openings 221 of the supporting plate 22.

On the other hand, since the membrane switch circuit member 21 is made of the light-transmissible material, the plural light beams B can be transmitted through the membrane switch circuit member 21. Consequently, after the plural light beams B are guided by the light-guiding dots 2302, the plural light beams B are sequentially transmitted through the plural supporting plate openings 221 and the membrane switch circuit member 21 and directed to the plural light-outputting zones 2011, thereby illuminating the character region or the symbol region of the keycap 201. Under this circumstance, the illuminating function is achieved.

Please refer to FIG. 2 again. For sealing the light guide plate 230, the lateral edges 2332 of the reflecting plate 233 have to be attached on the light-sheltering plate 234. Consequently, the light beams B are not leaked from the lateral edges of the light guide plate 230. That is, the problem of causing light leakage will be eliminated. Since the lateral edge 2332 of the reflecting plate 233 is attached on the light-sheltering plate 234, the attaching structure between the lateral edges 2332 of the reflecting plate 233 and the light-sheltering plate 234 occupies a space, it is difficult to reduce the volume of the luminous keyboard.

Therefore, there is a need of providing a luminous keyboard with reduced volume and capable of solving the lateral light leakage problem.

SUMMARY OF THE INVENTION

An object of the present invention provides a luminous keyboard with reduced volume and capable of solving the lateral light leakage problem.

In accordance with an aspect of the present invention, there is provided a luminous keyboard. The luminous keyboard includes at least one key, a membrane switch circuit member, a supporting plate and a backlight module. The at least one key is exposed outside the luminous keyboard. The membrane switch circuit member is located under the at least one key, and includes an upper wiring plate, a lower wiring plate and a separation plate. When the membrane switch circuit member is triggered by the at least one key, a corresponding key signal is generated. The upper wiring plate is contacted with the at least one key. The lower wiring plate is located under the upper wiring plate. The separation layer is arranged between the upper wiring plate and the lower wiring plate. The upper wiring plate and the lower wiring plate are separated from each other by the separation layer. The supporting plate is located under the membrane switch circuit member and connected with the at least one key. The backlight module is located under the supporting plate. The backlight module generates a light beam and projects the light beam to the at least one key. A periphery region of at least one of the upper wiring plate, the lower wiring plate and the separation plate is extended over the supporting plate and bent to cover a periphery region of the supporting plate and a periphery region of the backlight module. Consequently, the light beam is not leaked out through the periphery region of the backlight module.

From the above descriptions, the present invention provides the luminous keyboard. The periphery region of the at least one of the upper wiring plate, the lower wiring plate and the separation layer of the membrane switch circuit member is extended over the supporting plate. The periphery region is bent to cover the periphery region of the supporting plate and the periphery region of the backlight module. Consequently, the light beams are not leaked out through the periphery region of the backlight module. Since the periphery region of the at least one of the upper wiring plate, the lower wiring plate and the separation layer is attached on the lateral edge and the bottom surface of the backlight module, the attaching structure of the conventional technology is omitted. Under this circumstance, the available space within the luminous keyboard is increased. In other words, the volume of the luminous keyboard can be further reduced.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

For overcoming the drawbacks of the conventional technology, the present invention provides a luminous keyboard.

Figure 1:
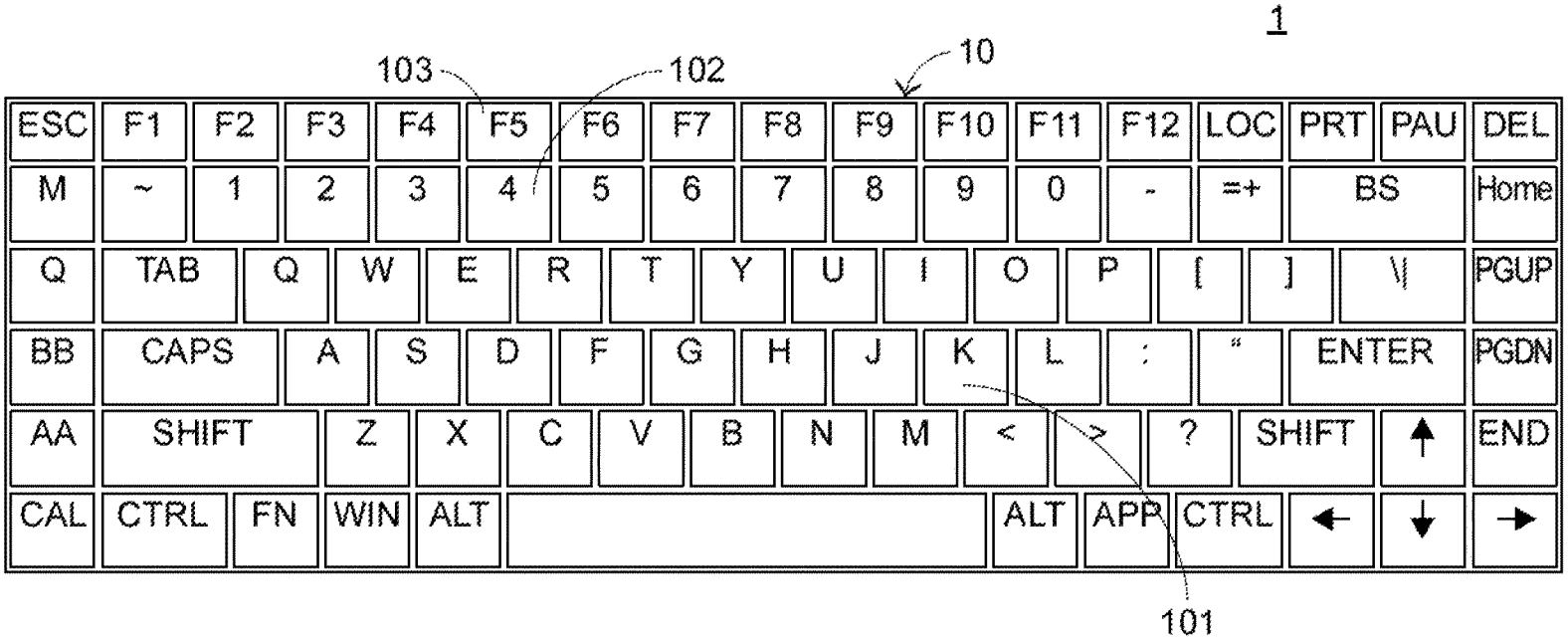
FIG. 1 PRIOR ART
FIG. 1 is a schematic top view illustrating the outer appearance of a conventional keyboard.
Figure 2:
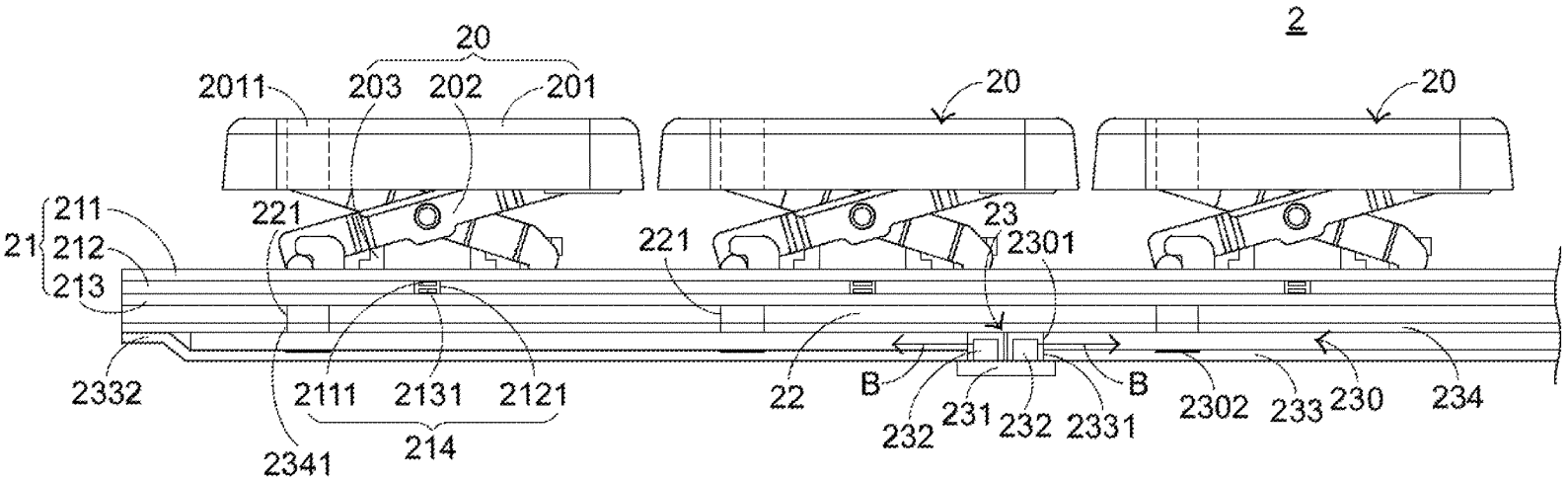
FIG.2 PRIOR ART
FIG. 2 is a schematic cross-sectional view illustrating a conventional luminous keyboard.
Figure 3:
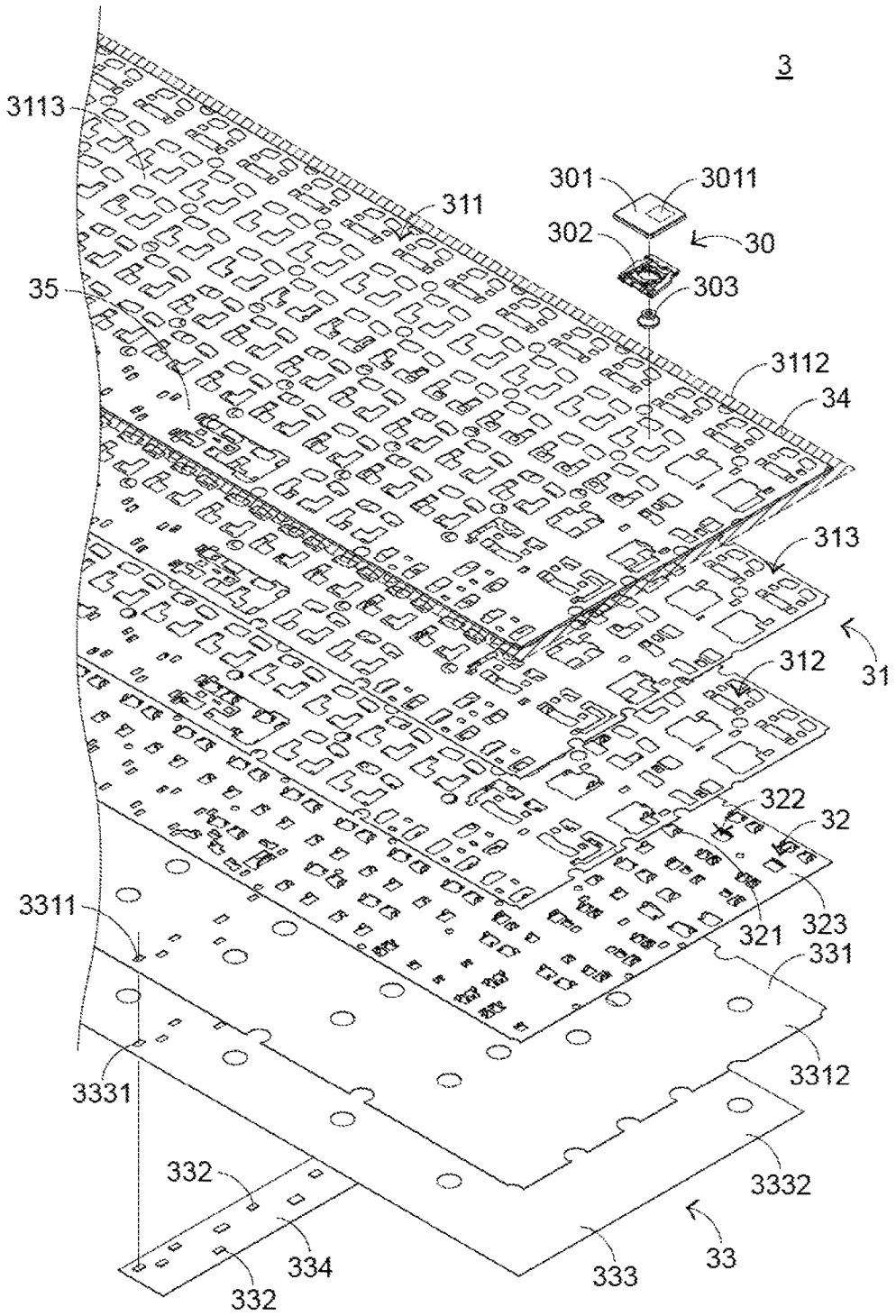
FIG. 3 is a schematic exploded view illustrating a portion of a luminous keyboard according to a first embodiment of the present invention.
Figure 4:
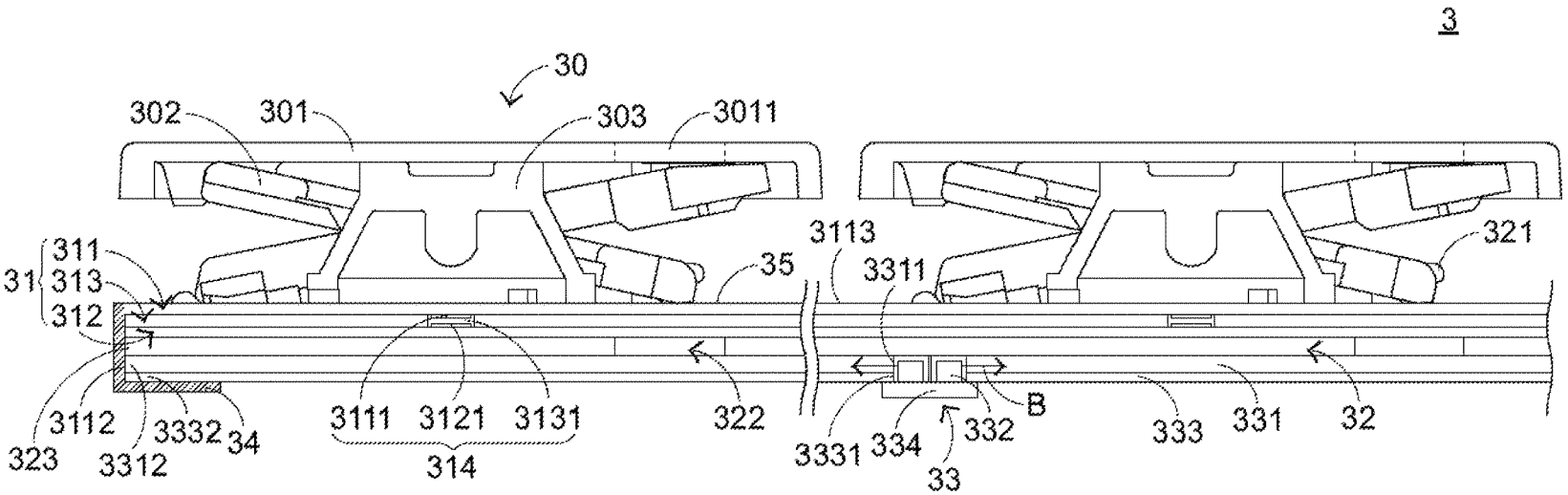
FIG. 4 is a schematic cross-sectional view illustrating a portion of the luminous keyboard according to the first embodiment of the present invention.

The structure of the luminous keyboard will be described with reference to FIGS. 3 and 4. FIG. 3 is a schematic exploded view illustrating a portion of a luminous keyboard according to a first embodiment of the present invention. FIG. 4 is a schematic cross-sectional view illustrating a portion of the luminous keyboard according to the first embodiment of the present invention. The luminous keyboard 3 comprises plural keys 30, a membrane switch circuit member 31, a supporting plate 32 and a backlight module 33. The plural keys 30 are exposed outside the luminous keyboard 3. The membrane switch circuit member 31 is located under the plural keys 30. When the membrane switch circuit member 31 is triggered by one of the plural keys 30, a corresponding key signal is generated. The supporting plate 32 is located under the membrane switch circuit member 31 and connected with the plural keys 30. The supporting plate 32 comprises plural hooks 321 and plural supporting plate openings 322. The backlight module 33 is located under the supporting plate 32. The backlight module 33 is used for emitting light beams B and projecting the light beams B to the plural keys 30.

As shown in FIGS. 3 and 4, each key 30 comprises a keycap 301, a connecting element 302 and an elastic element 303. Each keycap 301 has a light-outputting zone 3011. After the light beams B pass through the light-outputting zone 3011, the key 31 is illuminated. The keycap 301 is exposed outside the luminous keyboard 3, and thus the keycap 301 can be depressed by the user. The scissors-type connecting element 302 is used for connecting the keycap 301 and the hooks 321 of the supporting plate 32. Consequently, the keycap 301 is moved upwardly or downwardly relative to the supporting plate 32. The elastic element 303 is penetrated through the connecting element 302. In addition, both ends of the elastic element 303 are contacted with the keycap 301 and the membrane switch circuit member 31, respectively. As the keycap 301 is moved downwardly to push the elastic element 303, the membrane switch circuit member 31 is triggered.

In this embodiment, the connecting element 302 is a scissors-type connecting element, and the elastic element 303 is a rubbery elastomer. Preferably but are not exclusively, the plural keycaps 301 of the plural keys are moved upwardly or downwardly with the connecting elements 302, and the membrane switch circuit member 31 is depressed by the elastic elements 303 through the connecting elements 302. In another embodiment, the connecting elements are non-scissors connecting elements for controlling movements of the keys. For example, a crater-shaped connecting element for a desktop computer is one of the non-scissors connecting elements. In a further embodiment, the keycaps are moved upwardly or downwardly in response to magnetic forces.

The structure of the membrane switch circuit member 31 will be described as follows. The membrane switch circuit member 31 comprises an upper wiring plate 311, a lower wiring plate 312 and a separation layer 313. The upper wiring plate 311 is contacted with the elastic elements 303 of the keys 30. The upper wiring board 311 has plural upper contacts 3111. The lower wiring plate 312 is located under the upper wiring plate 311. The lower wiring plate 312 comprises plural lower contacts 3121 corresponding to the plural upper contacts 3111. The separation layer 313 is arranged between the upper wiring plate 311 and the lower wiring plate 312. When the key 30 is not depressed, the upper wiring plate 311 and the lower wiring plate 312 are separated from each other by the separation layer 313. Consequently, the upper contact 3111 and the corresponding low contact 3121 are not erroneously contacted. The separation layer 313 comprises plural perforations 3131 corresponding to the plural upper contacts 3131. The plural upper contacts 3131, the plural lower contacts 3121 and the plural perforations 3131 are collectively defined as plural key switches 314. When the membrane switch circuit member 31 is pressed by the elastic element 303, the corresponding upper contact 3111 is inserted into the corresponding perforation 3131 and contacted with the corresponding lower contact 3121. Consequently, the corresponding key signal is generated.

The structure of the backlight module 33 will be described as follows. The backlight module 33 comprises a light guide plate 331, plural light-emitting elements 332, a reflecting plate 333 and a circuit board 334. The light guide plate 331 is located under the supporting plate 32. The light guide plate 331 is used for guiding the light beams B to the light-outputting zones 3011. The light guide plate 331 comprises plural light guide plate openings 3311 and plural light-guiding parts (not shown). Each light guide plate opening 3311 is aligned with one of the plural light-emitting elements 332. The light-guiding parts are used for guiding the light beams B to be exited from the light guide plate 331 and projected to the light-outputting zones 3011. The reflecting plate 333 is located under the light guide plate 331. After portions of the light beams B are exited from the light guide plate 331, the light beams B are reflected back into the light guide plate 331 by the reflecting plate 333. Consequently, the utilization efficiency of the light beam B is enhanced. The reflecting plate 333 comprises plural reflecting plate openings 3331 corresponding to the plural light-emitting elements 332. The light-emitting elements 332 emit the light beams B. In addition, the plural light-emitting elements 332 are inserted into the corresponding reflecting plate openings 3331 and the corresponding light guide plate openings 3311. Consequently, the light beams B can be introduced into the light guide plate 331. The circuit board 334 is located under the reflecting plate 333 and electrically connected with the light-emitting elements 332. The plural light-emitting elements 332 are supported on the circuit board 334. The circuit board 334 provides electric power to the plural light-emitting elements 332. By acquiring the electric power, the plural light-emitting elements 332 are driven to emit plural light beams B. In this embodiment, the light-emitting element 332 is a side-view light emitting diode, the light-guiding part is one of a light-guiding microstructure, a light-guiding dot, a light-guiding ink and a light-guiding texturing structure, and the circuit board 334 is a flexible printed circuit (FPC).

When the light-emitting elements 332 are driven to emit the light beams B, the light beams B are introduced into the light guide plate 331. The light beams B are guided by the light-guiding parts and exited from the light guide plate 331. Then, the light beams B are transmitted through the corresponding supporting plate openings 322 and the membrane switch circuit member 31. Consequently, the light beams B are projected to the light-outputting zones 3011 of the keycaps 301. Moreover, portions of the light beams B are exited from the light guide plate 331 but not guided by the light-guiding parts. The portions of the light beams B that are exited from the light guide plate 331 are reflected back into the light guide plate 311 by the reflecting plate 333 and further guided to the light-outputting zones 3011 by the light-guiding parts.

The operations of depressing the keycap 301 of the luminous keyboard 3 will be described as follows. Please refer to FIG. 3 again. While one of the keycaps 301 is depressed by the user's finger, the keycap 301 is moved downwardly. Since the connecting element 302 is pushed by the keycap 301, the connecting element 302 is correspondingly swung relative to the supporting plate 32. Moreover, as the keycap 301 is moved downwardly to push the elastic element 303, the elastic element 303 is subjected to deformation to trigger the corresponding key switch 314 of the membrane switch circuit member 31. Consequently, the corresponding key signal is generated. When the keycap 301 is no longer depressed by the user and no external force is exerted on the keycap 301, the elastic element 303 is not pushed by the keycap 301. Meanwhile, the elastic element 303 is restored to its original shape from the deformed state in response to the elasticity of the elastic element 303. In addition, the elastic element 303 provides an upward restoring force to the keycap 301. As the keycap 301 is moved upwardly, the connecting element 302 is correspondingly swung. Consequently, the keycap 301 is returned to its original position.

The following three aspects should be specially described. Firstly, a periphery region 3112 of the upper wiring plate 311 (i.e., the region circumscribed by dotted lines as shown in FIG. 3) is extended over the lower wiring plate 312, the separation layer 313, the supporting plate 32 and the backlight module 33. That is, the size of the upper wiring plate 311 is larger than the size of the lower wiring plate 312, the size of the separation layer 313, the size of the supporting plate 32 and the size of the light guide plate 331. Consequently, the periphery region 3112 of the upper wiring plate 311 is bendable to cover a periphery region 323 of the supporting plate 32, a periphery region 3312 of the light guide plate 331 and a periphery region 3332 of the reflecting plate 333.

Secondly, a first light-sheltering structure 34 as shown in FIG. 3 and indicated by dotted lines is formed on the periphery region 3112 of the upper wiring plate 311. For example, the first light-sheltering structure 34 is produced by printing or spraying a light-sheltering material on the periphery region 3112 of the upper wiring plate 311. Due to the first light-sheltering structure 34, the periphery region 3112 of the upper wiring plate 311 has the function of sheltering the light beams B. Consequently, the light beams B are not leaked out through the periphery region 3312 of the light guide plate 331.

Thirdly, a second light-sheltering structure 35 is formed on an inner region 3113 of the upper wiring plate 311. The second light-sheltering structure 35 is arranged between the plural keycaps 301 and the backlight module 33 to shelter the light beams B. Moreover, the second light-sheltering structure 35 is not aligned with the plural light-outputting zones 3011. Consequently, the light beams B can be transmitted through the lower wiring plate 312, the separation layer 313 and the upper wiring plate 311 and projected to the light-outputting zones 3011. Due to the arrangement of the second light-sheltering structure 35, it is not necessary to install a light-sheltering plate in the luminous keyboard of the present invention. In an embodiment, the first light-sheltering structure 34 and the second light-sheltering structure 35 are produced by printing or spraying light-sheltering ink. It is noted that the position of the second light-sheltering structure is not restricted to the inner region of the upper wiring plate. In another embodiment, the second light-sheltering structure is formed on an inner region of the lower wiring plate or an inner region of the separation layer.

Figure 5:
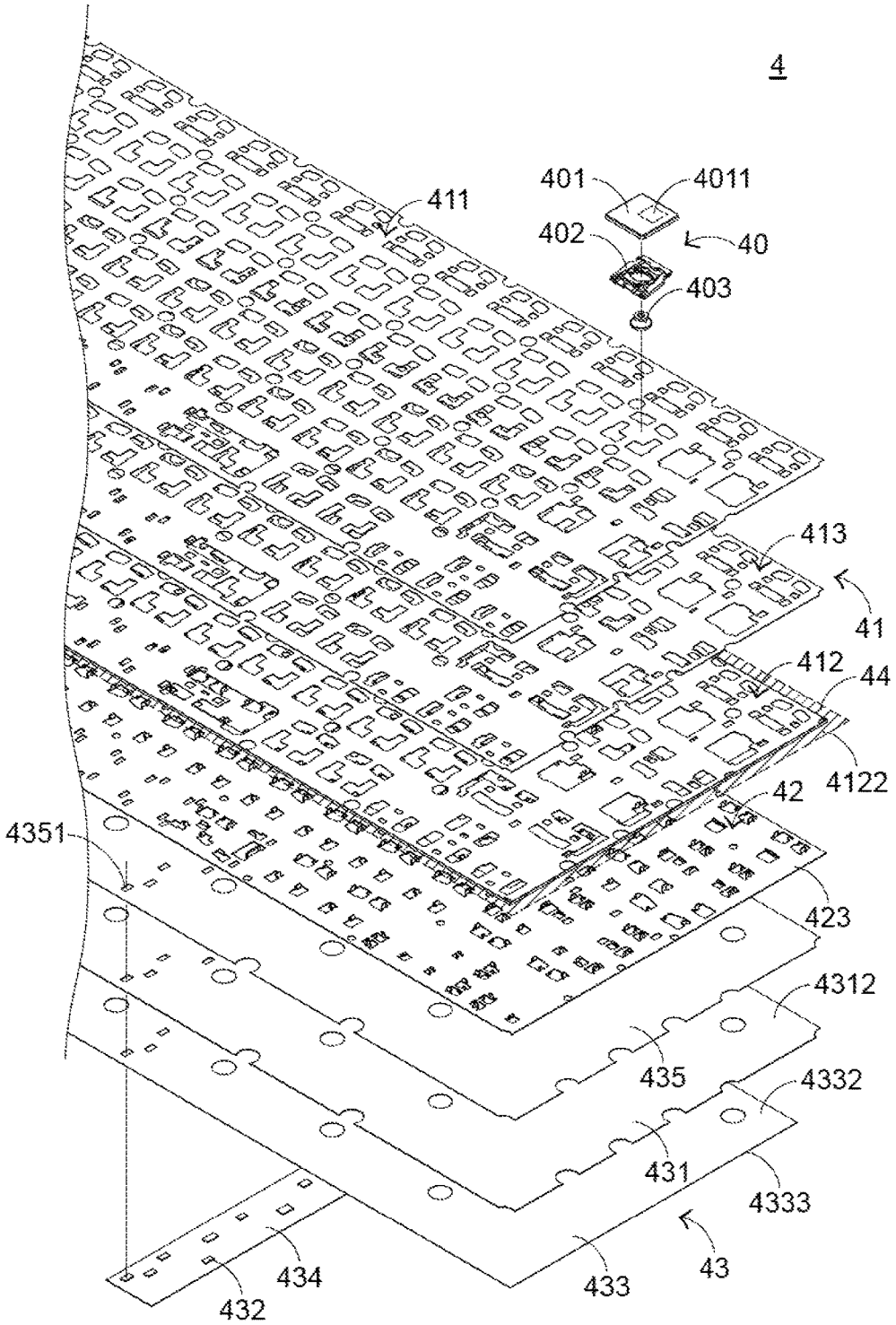
FIG. 5 is a schematic exploded view illustrating a portion of a luminous keyboard according to a second embodiment of the present invention.
Figure 6:
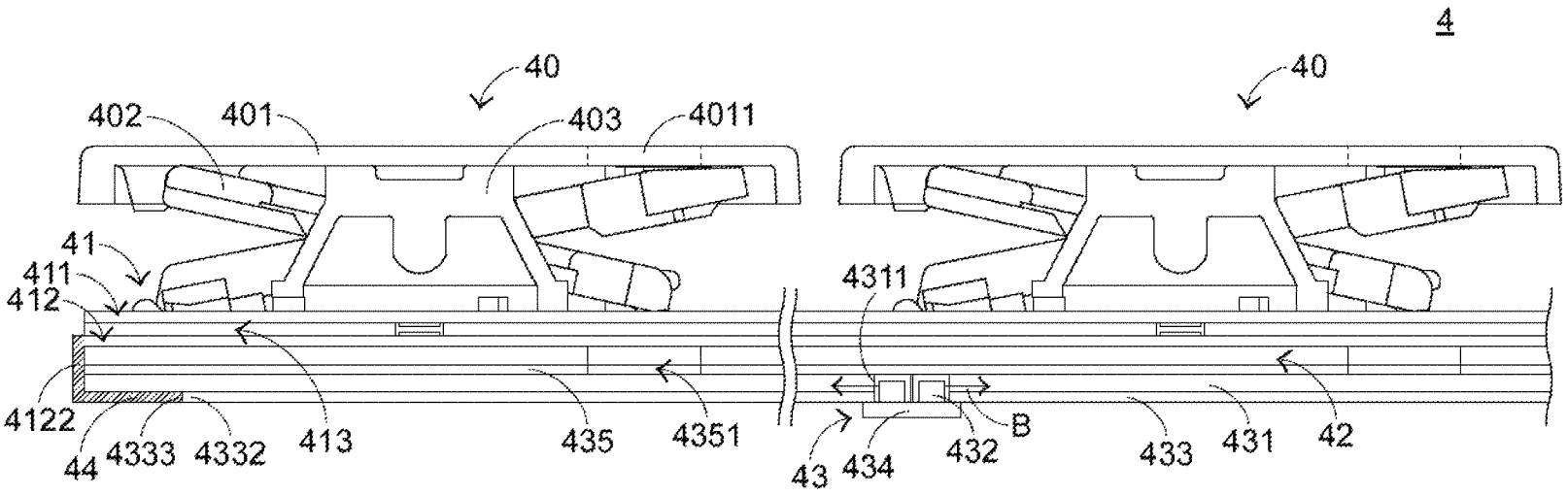
FIG. 6 is a schematic cross-sectional view illustrating a portion of the luminous keyboard according to the second embodiment of the present invention.

The present invention further comprises a second embodiment, which is distinguished from the first embodiment. FIG. 5 is a schematic exploded view illustrating a portion of a luminous keyboard according to a second embodiment of the present invention. FIG. 6 is a schematic cross-sectional view illustrating a portion of the luminous keyboard according to the second embodiment of the present invention. As shown in FIGS. 5 and 6, the luminous keyboard 4 comprises plural keys 40, a membrane switch circuit member 41, a supporting plate 42 and a backlight module 43. Each key 40 comprises a keycap 401, a connecting element 402 and an elastic element 403. Each keycap 401 has a light-outputting zone 4011. The membrane switch circuit member 41 comprises an upper wiring plate 411, a lower wiring plate 412 and a separation layer 413. The backlight module 43 comprises a light guide plate 431, plural light-emitting elements 432, a reflecting plate 433, a circuit board 434 and a light-sheltering plate 435. Except for the following two items, the structure of the luminous keyboard 4 of this embodiment is substantially identical to the structure of the luminous keyboard 3 of the first embodiment. Firstly, the structure of the membrane switch circuit member 41 is distinguished. Secondly, the backlight module 43 further comprises the light-sheltering plate 435.

The structure of the membrane switch circuit member 41 will be described as follows. In this embodiment, a periphery region 4122 of the lower wiring plate 412 (i.e., the region circumscribed by dotted lines as shown in FIG. 5) is extended over the upper wiring plate 411, the separation layer 413, the supporting plate 42 and the backlight module 43. That is, the size of the lower wiring plate 412 is larger than the size of the upper wiring plate 412, the size of the separation layer 413, the size of the supporting plate 42 and the size of the light guide plate 431. Consequently, the periphery region 4122 of the lower wiring plate 412 is bendable to cover a periphery region 423 of the supporting plate 42 and a periphery region 4312 of the light guide plate 431. Moreover, a light-sheltering structure 44 is formed on the periphery region 4122 of the lower wiring plate 412. For example, the light-sheltering structure 44 is produced by printing or spraying a light-sheltering material on the periphery region 4122 of the lower wiring plate 412. Due to the light-sheltering structure 44, the periphery region 4122 of the lower wiring plate 412 has the function of sheltering the light beams B. Consequently, the light beams B are not leaked out through the periphery region 4312 of the light guide plate 431.

The light-sheltering plate 435 of the backlight module 43 is arranged between the light guide plate 431 and the supporting plate 42 to shelter the light beams B. Consequently, the light beams B are allowed to be projected to the light-outputting zones 4011 only. The light-sheltering plate 435 comprises plural light-sheltering plate openings 4351 corresponding to the light-outputting zones 4011. The light beams B are transmitted through the light-sheltering plate openings 4351 of the light-sheltering plate 435 and projected to the light-outputting zones 4011.

As shown in FIG. 6, the periphery region 423 of the supporting plate 42 and the periphery region 4312 of the light guide plate 431 are covered by the periphery region 4122 of the lower wiring plate 412, but a periphery region 4332 of the reflecting plate 433 is not covered by the periphery region 4122 of the lower wiring plate 412. In this embodiment, a lateral edge 4333 of the reflecting plate 433 is covered by the periphery region 4122 of the lower wiring plate 412. That is, the bottom surface of the periphery region 4122 of the lower wiring plate 412 and the bottom surface of the reflecting plate 433 are aligned with each other and located at the same level. Since the thickness of the luminous keyboard 4 is reduced, the volume of the luminous keyboard 4 is reduced In the above embodiments, the periphery region of the upper wiring plate or the periphery region of the lower wiring plate is bent to cover the backlight module. It is noted that numerous modifications may be made while retaining the teachings of the present invention. For example, in another embodiment, the periphery region of the separation layer is bent to cover the backlight module.

From the above descriptions, the present invention provides the luminous keyboard. The periphery region of at least one of the upper wiring plate, the lower wiring plate and the separation layer of the membrane switch circuit member is extended over the supporting plate. The periphery region is bent to cover the periphery region of the supporting plate and the periphery region of the backlight module. Consequently, the light beams are not leaked out through the periphery region of the backlight module. Since the periphery region of the at least one of the upper wiring plate, the lower wiring plate and the separation layer is attached on the lateral edge and the bottom surface of the backlight module, the attaching structure of the conventional technology is omitted. Under this circumstance, the available space within the luminous keyboard is increased. In other words, the volume of the luminous keyboard can be further reduced.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all modifications and similar structures.

What is claimed is:

1. A luminous keyboard, comprising:

at least one key exposed outside the luminous keyboard;

a membrane switch circuit member located under the at least one key, and comprising an upper wiring plate, a lower wiring plate and a separation plate, wherein when the membrane switch circuit member is triggered by the at least one key, a corresponding key signal is generated, wherein the upper wiring plate is contacted with the at least one key, the lower wiring plate is located under the upper wiring plate, a separation layer is arranged between the upper wiring plate and the lower wiring plate, and the upper wiring plate and the lower wiring plate are separated from each other by the separation layer;

a supporting plate located under the membrane switch circuit member and connected with the at least one key; and a backlight module located under the supporting plate, and generating a light beam and projecting the light beam to the at least one key, wherein a periphery region of at least one of the upper wiring plate, the lower wiring plate and the separation plate is extended over the supporting plate and bent to cover a periphery region of the supporting plate and a periphery region of the backlight module, so that the light beam is not leaked out through the periphery region of the backlight module, wherein the at least one key comprises:

a keycap exposed outside the luminous keyboard, wherein the keycap comprises at least one light-outputting zone, and the light beam is transmitted through the at least one light-outputting zone;

a connecting element arranged between the supporting plate and the keycap, wherein the supporting plate is connected with the keycap through the connecting element, so that the keycap is movable upwardly or downwardly relative to the supporting plate; and an elastic element arranged between the keycap and the upper wiring plate, wherein while the keycap is depressed to push the elastic element, the upper wiring plate is pressed by the elastic element, and wherein the backlight module comprises:

a light guide plate located under the supporting plate to guide the light beam to the at least one light-outputting zone, wherein the light guide plate comprises a light guide plate opening;

a light-emitting element emitting the light beam;

a reflecting plate located under the light guide plate, wherein when a portion of the light beam is exited from the light guide plate, the light beam is reflected back into the light guide plate by the reflecting plate, wherein the reflecting plate comprises a reflecting plate opening;

a circuit board located under the reflecting plate and electrically connected with the light-emitting element, wherein the light-emitting element is supported on the circuit board, and the light-emitting element is inserted into the reflecting plate opening and the light guide plate opening, so that the light beam is introduced into the light guide plate; and a light-sheltering plate, which is arranged between the light guide plate and the supporting plate to shelter the light beam, wherein the light-sheltering plate comprises at least one light-sheltering plate opening corresponding to the at least one light-outputting zone, and the light beam is transmitted through the at least one light-sheltering plate opening of the light-sheltering plate.

2. The luminous keyboard according to claim 1, wherein a first light-sheltering structure is printed or sprayed on the periphery region of the at least one of the upper wiring plate, the lower wiring plate and the separation plate, so that the light beam is sheltered by the periphery region of the at least one of the upper wiring plate, the lower wiring plate and the separation plate.

3. The luminous keyboard according to claim 1, wherein while the keycap is depressed, the connecting element is correspondingly swung and the elastic element is pushed by the keycap, so that the elastic element is subjected to deformation to press the upper wiring plate, wherein when the keycap is not depressed, the elastic element is restored to an original shape and provides an elastic force to the keycap, so that the keycap is returned to an original position.

4. The luminous keyboard according to claim 1, wherein a second light-sheltering structure is formed on an inner region of at least one of the upper wiring plate, the lower wiring plate and the separation plate and arranged between the at least one keycap and the backlight module to shelter the light beam, wherein the second light-sheltering structure is not aligned with the at least one light-outputting zone, so that the light beam is transmitted through the lower wiring plate, the separation layer and the upper wiring plate and projected to the light-outputting zone.

5. The luminous keyboard according to claim 1, wherein a second light-sheltering structure is produced by a printing process or a spraying process.

6. The luminous keyboard according to claim 1, wherein a periphery region of the light guide plate and a periphery region of the reflecting plate are covered by the periphery region of the at least one of the upper wiring plate, the lower wiring plate and the separation plate.

7. The luminous keyboard according to claim 1, wherein a periphery region of the light guide plate is covered by the periphery region of the at least one of the upper wiring plate, the lower wiring plate and the separation plate, and a lateral edge of the reflecting plate is covered by the periphery region of the at least one of the upper wiring plate, the lower wiring plate and the separation plate.

* * * * *